US007182036B2

(12) United States Patent
Levine

(10) Patent No.: US 7,182,036 B2
(45) Date of Patent: Feb. 27, 2007

(54) SHOCK LIMITED HYDROFOIL SYSTEM

(76) Inventor: Gerald A. Levine, 9525 Majestic Way, Boynton Beach, FL (US) 33437

( * ) Notice: Subject to any disclaimer, the term of this patent is extended or adjusted under 35 U.S.C. 154(b) by 0 days.

(21) Appl. No.: 11/141,946

(22) Filed: Jun. 1, 2005

(65) Prior Publication Data

US 2006/0070565 A1 Apr. 6, 2006

Related U.S. Application Data

(63) Continuation-in-part of application No. 10/770,079, filed on Feb. 2, 2004, which is a continuation-in-part of application No. 10/364,589, filed on Feb. 10, 2003, now Pat. No. 6,948,441.

(51) Int. Cl.
*B63B 1/26* (2006.01)

(52) U.S. Cl. ..... 114/274; 114/275

(58) Field of Classification Search ..... 114/274–282, 114/144 RE; 440/1, 87
See application file for complete search history.

(56) References Cited

U.S. PATENT DOCUMENTS

| | | | | |
|---|---|---|---|---|
| 1,410,876 | A | | 3/1922 | Bell et al. |
| 2,139,303 | A | | 12/1938 | Grunberg |
| 2,387,907 | A | * | 10/1945 | Hook ..... 114/276 |
| 2,584,347 | A | | 2/1952 | Hazard |
| 2,914,014 | A | | 11/1959 | Carl et al. |
| 3,081,728 | A | | 3/1963 | Wilterdink et al. |
| 3,092,062 | A | | 6/1963 | Savitsky |
| 3,139,059 | A | | 6/1964 | Hanford, Jr. |
| 3,175,526 | A | | 3/1965 | Johnson, Jr. et al. |
| 3,357,390 | A | | 12/1967 | Wray, Jr. |
| 3,364,892 | A | | 1/1968 | Persson et al. |
| 3,693,570 | A | | 9/1972 | Erlykin et al. |
| 3,704,442 | A | | 11/1972 | Wright |
| 3,785,319 | A | | 1/1974 | Danforth |
| 3,789,789 | A | | 2/1974 | Cleary |
| 3,800,727 | A | | 4/1974 | Stark et al. |
| 3,804,048 | A | | 4/1974 | Cline |
| 3,842,774 | A | | 10/1974 | Kinder |
| 3,886,884 | A | | 6/1975 | Stark et al. |
| 3,899,987 | A | | 8/1975 | Wright et al. |
| 3,902,444 | A | | 9/1975 | Stark |
| 3,910,216 | A | | 10/1975 | Shultz |
| 3,946,688 | A | | 3/1976 | Gornstein et al. |
| 3,958,522 | A | | 5/1976 | Harang et al. |
| 3,964,417 | A | | 6/1976 | Williams et al. |
| 3,977,348 | A | | 8/1976 | Bordat et al. |
| 4,027,835 | A | | 6/1977 | Sachs |
| 4,056,074 | A | | 11/1977 | Sachs |
| 4,159,690 | A | | 7/1979 | Farris |
| 4,178,871 | A | | 12/1979 | Hirsch |
| 4,182,256 | A | | 1/1980 | Scott et al. |

(Continued)

*Primary Examiner*—Ed Swinehart
(74) *Attorney, Agent, or Firm*—Christopher & Weisberg, P.A.

(57) ABSTRACT

A shock mitigation system for a hydrofoil marine craft is provided, the shock mitigation system includes a pair of stacked lifting bodies, where an upper lifting body is used to provide initial lift for the craft. To mitigate the wave effects on the craft when operating at cruise speed, the distance between the upper lifting bodies and the waterline is proportionally related to the operational wave height. When operated within the selected operational parameters, the distance between the upper lifting bodies and waterline prevents the upper lifting bodies from becoming wetted and producing sudden increases in lift from wave impact.

5 Claims, 7 Drawing Sheets

U.S. PATENT DOCUMENTS 4,207,830 A 6/1980 Wankel
4,962,718 A 10/1990 Gornstein et al.
5,117,776 A 6/1992 Thorpe
5,309,859 A * 5/1994 Miller ..... 114/274
5,373,800 A 12/1994 Steinberg
5,408,948 A * 4/1995 Arii et al. ..... 114/274
5,469,801 A 11/1995 Payne
6,095,076 A 8/2000 Nesbitt
6,164,235 A 12/2000 Hoppe
6,439,148 B1 8/2002 Lang

* cited by examiner

SHOCK LIMITED HYDROFOIL SYSTEM

CROSS-REFERENCE TO RELATED APPLICATION

This application is a continuation-in-part of pending U.S. Utility patent application Ser. No. 10/770,079, filed Feb. 2, 2004, entitled SHOCK LIMITED HYDROFOIL SYSTEM, which application is a continuation-in-part of U.S. Utility patent application Ser. No. 10/364,589, filed Feb. 10, 2003, now U.S. Pat. No. 6,948,441 entitled SHOCK LIMITED HYDROFOIL SYSTEM, now allowed, the entirety of which is incorporated herein by reference.

STATEMENT REGARDING FEDERALLY SPONSORED RESEARCH OR DEVELOPMENT n/a

FIELD OF THE INVENTION

The present invention relates to hydrofoil marine vehicles and more particularly to a hydrofoil configuration to mitigate the effects of wave shock.

BACKGROUND OF THE INVENTION

The hydrofoil vehicle is analagous to an aircraft, where the wings operate under water. The basic principle of the hydrofoil concept is to lift a craft's hull out of the water and support it dynamically on the submerged wings, i.e. hydrofoils. The hydrofoils can reduce the effect of waves on the craft and reduce the power required to attain modestly high speeds. As the craft's speed is increased the water flow over the hydrofoils increase, generating a lifting force and causing the craft to rise. For a given speed the craft will rise until the lifting force produced by the hydrofoils equals the weight of the craft.

In a typical arrangement, struts connect the hydrofoils to the craft's hull, where the struts have sufficient length to support the hull free of the water surface when operating at cruise speeds. As shown in FIGS. 1*a*–1*c*, the basic choices in hydrofoil and strut arrangement are conventional, canard, or tandem. In an example of a conventional arrangement, as shown in FIG. 1*b*, a pair of struts and hydrofoils are positioned fore of the craft's center of gravity, symmetrical about the craft's longitudinal centerline, and a single strut and hydrofoil is positioned aft of the craft's center of gravity along the craft's longitudinal centerline. In a canard arrangement, as shown in FIG. 1*c*, a single strut and hydrofoil is positioned fore of the craft's center of gravity along the craft's longitudinal centerline, and a pair of struts and hydrofoils are positioned aft of the craft's center of gravity, symmetrical about the craft's longitudinal centerline.

Alternatively, the pairs of struts can include a single hydrofoil, spanning the beam of the craft. Generally, craft are considered conventional or canard if 65% or more of the weight is supported on the fore or the aft foil respectively.

In a tandem arrangement, as shown in FIG. 1*a*, pairs of struts and hydrofoils are positioned fore and aft of the craft's center of gravity and symmetrically about the craft's longitudinal centerline. Alternatively, the pairs of struts can include a single hydrofoil, spanning the beam of the craft. If the weight is distributed relatively evenly on the fore and aft hydrofoils, the configuration would be described as tandem.

The hydrofoil's configuration on the strut can be divided into two general classifications, fully submerged and surface piercing. Fully submerged hydrofoils are configured to operate at all times under the water surface. The principal and unique operational capability of craft with fully submerged hydrofoils is the ability to uncouple the craft to a substantial degree from the effect of waves. This permits a hydrofoil craft to operate foil borne at high speed in sea conditions normally encountered while maintaining a comfortable motion environment.

However, the fully submerged hydrofoil system is not self-stabilizing. Consequently, to maintain a specific height above the water, and a straight and level course in pitch and yaw axes, usually requires an independent control system. The independent control system varies the effective angle of attack of the hydrofoils or adjusts trim tabs or flaps mounted on the foils, changing the lifting force in response to changing conditions of craft speed, weight, and sea conditions.

In the surface piercing concept, portions of the hydrofoils are configured to extend through the air/sea interface when foil borne. As speed is increased, the lifting force generated by the water flow over the submerged portion of the hydrofoils increases, causing the craft to rise and the submerged area of the foils to decrease. For a given speed the craft will rise until the lifting force produced by the submerged portion of the hydrofoils equals the weight of the craft. However, because a portion of the surface-piercing hydrofoil is always in contact with the water surface, and therefore the waves, the surface-piercing foil is susceptible to the adverse affect of wave action. The impact of the waves can impart sudden, large forces onto the struts and craft, resulting in an erratic and dangerous motion environment.

Additionally, hydrofoil configurations can include a stack foil, or ladder foil, arrangement, where upper foils are used to provide lift at lower speed, initially raising the craft above the waterline. As the craft's speed is increased, the lower foils produce sufficient lift to support the weight of the craft, further raising the upper foils above the waterline to the cruise height. However, when a wave impacts the craft the upper foil can be instantaneously wetted, producing a sudden increase in lift. The sudden increase in lift produces a jarring impact on the craft, and in some instance can be sufficient enough to instantaneously raise the entire craft, including the main foils, above the waterline.

A hydrofoil vehicle is configured to operate at a particular cruise speed. The cruise speed is the speed at which the total lifting force produced by the hydrofoils equals the all up weight of the hydrofoil vehicle. Operating at speeds greater than the cruise speed can cause the hydrofoils to produce excessive lift, resulting in a cyclic skipping action. At speeds less than the cruise speed, when the hydrofoils do not produce sufficient lift to raise vehicle results in the hull crashing into the water.

Propulsion systems for hydrofoil vehicles can include both water and air propulsion systems. In an exemplary arrangement of a water propulsion system, a water propeller provides the propulsive force, where a drive shaft operably connects the water propeller to an engine. Alternatively, a water jet can be used to provide the propulsive force, where water is funneled through a water intake into the water jet. The water jet accelerates the water, expelling the water through the outlet creating a propulsive force. Air propulsion systems can include for example, air propeller or jet engines. As shown in U.S. Pat. No. 4,962,718 to Gornstein et al., an air propeller is positioned on the deck of the craft and operatively connected to an engine.

SUMMARY OF THE INVENTION

The present invention provides a shock mitigation system for hydrofoil marine craft. The shock mitigation system includes a pair of stacked lifting bodies, where an upper lifting body is used to provide initial lift for the craft. As the craft's speed is increased, the lower lifting body produces sufficient lift to raise the craft and upper lifting body to a specified cruising height. The craft is configured to operate at this selected cruising height and at a maximum wave height, where the wave height is defined as the distance between the crest and trough of a wave. To mitigate the wave effects on the craft when operating at the selected cruise height, the distance between the upper lifting body and the waterline is proportionally related to the maximum wave height to be encountered. When used within the operational parameters, the distance between the upper lifting body and waterline prevents the upper lifting body from becoming wetted and producing sudden increases in lift from wave impact.

The hydrofoil marine craft is configured to operate at either a selected cruise height above the waterline or having a selected hydrofoil wetted portion. This selected cruise height or hydrofoil wetted portion can be maintained by adjusting the thrust output of the propulsion system. To raise the craft to the selected cruise height or selected wetted portion, the thrust output is increased. Similarly, to lower the craft to the selected cruise height or selected wetted portion, the thrust output is decreased.

Alternatively, the cruise height or selected wetted portion can be maintained by adjusting the lower lifting body's angle of attack. An increase in the angle of attack will result in an increase in lift, raising the craft to the selected cruise height or selected wetted portion. A decrease in the angle of attack will result in a decrease in lift, lowering the craft to the selected cruise height or selected wetted portion.

Advantageously, the above system can also be used to increase or decrease the cruise speed, while maintaining the selected cruise height or selected wetted portion. For example, a decrease in the angle of attack and an increase in the thrust will result in a higher cruise speed, while maintaining the selected cruise height or selected wetted portion. Similarly, an increase in the angle of attack and a decrease in the thrust will result in a lower cruise speed, while maintaining the selected cruise height or selected wetted portion.

In an alternative configuration a hydrofoil craft includes a hull having a longitudinal axis, a pylon secured to and extending beneath the hull and a lifting foil secured to the pylon. The lifting foil has an upper surface and a lower surface. The upper surface of the lifting foil is substantially planar and the lower surface of the lifting foil is not coplanar with the upper lifting surface. The lifting foil has a fore portion and an aft portion that are traversed by a longitudinal axis and wherein the longitudinal axis is substantially parallel to the longitudinal axis of the hull and the thickness of the foil is greater at the aft portion than at the fore portion.

In yet another configuration for a shock limitation system, a marine craft is configured for operation in water having a known wave height and includes a hull adapted to carry a payload and first and second lifting bodies secured below the hull a predetermined distance, wherein the predetermined distance exceeds the known wave height. The first and second lifting bodies, as well as the hull can be displacement hulls and the first and second lifting bodies can be secured to the hull with struts.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present invention advantageously provides a shock mitigation system for hydrofoil marine craft. The shock mitigation system includes a pair of stacked lifting bodies, where an upper lifting body is used to provide initial lift for the craft. As the craft's speed is increased, the lower lifting body produces sufficient lift to raise the craft and upper lifting body above the waterline, reaching a targeted cruise height. The craft is configured to operate at a selected maximum wave height, where wave height is defined as the distance between the crest and trough of a wave. To mitigate the wave effects on the craft when operating at the cruise height, the distance between the upper lifting body and the waterline is proportionally related to the maximum wave height. When used within the operational parameters, the distance between the upper lifting body and the waterline prevents the upper lifting body from becoming wetted and producing sudden increases in lift from wave impacts.

Figure 1A:
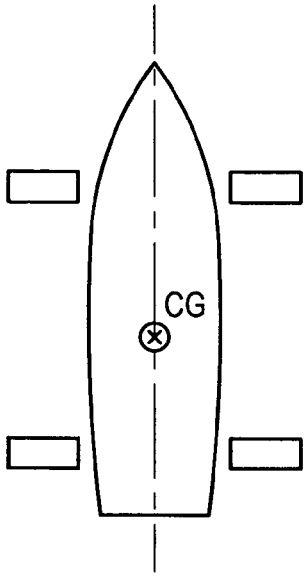
Fig. 1A (Prior Art)
FIGS. 1*a*–1*c* are prior art hydrofoil configurations of hydrofoil marine craft.
Figure 1B:
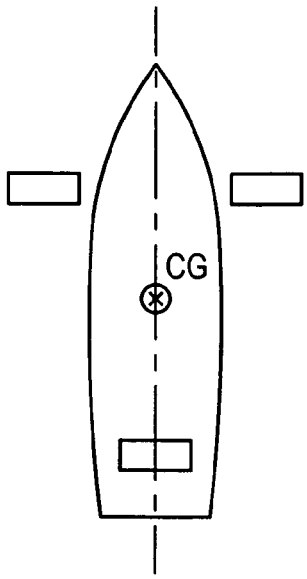
Fig. 1B (Prior Art)
Figure 1C:
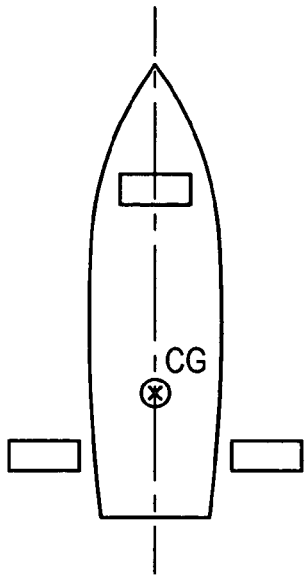
Fig. 1C (Prior Art)
Figure 2:
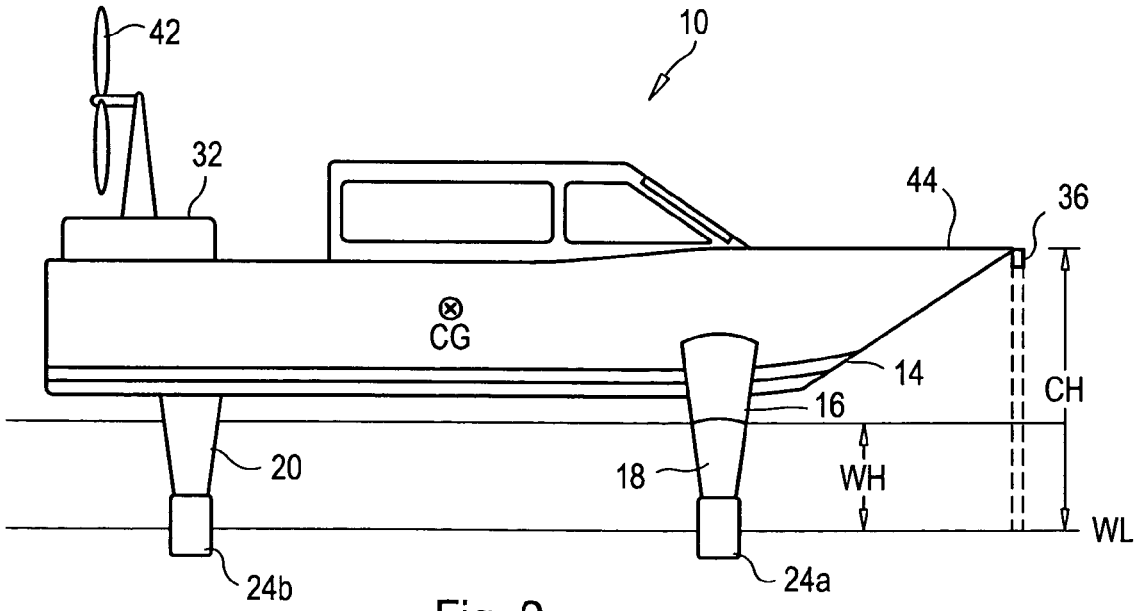
FIG. 2 is a side view of the hydrofoil marine craft of the present invention.
Figure 3:
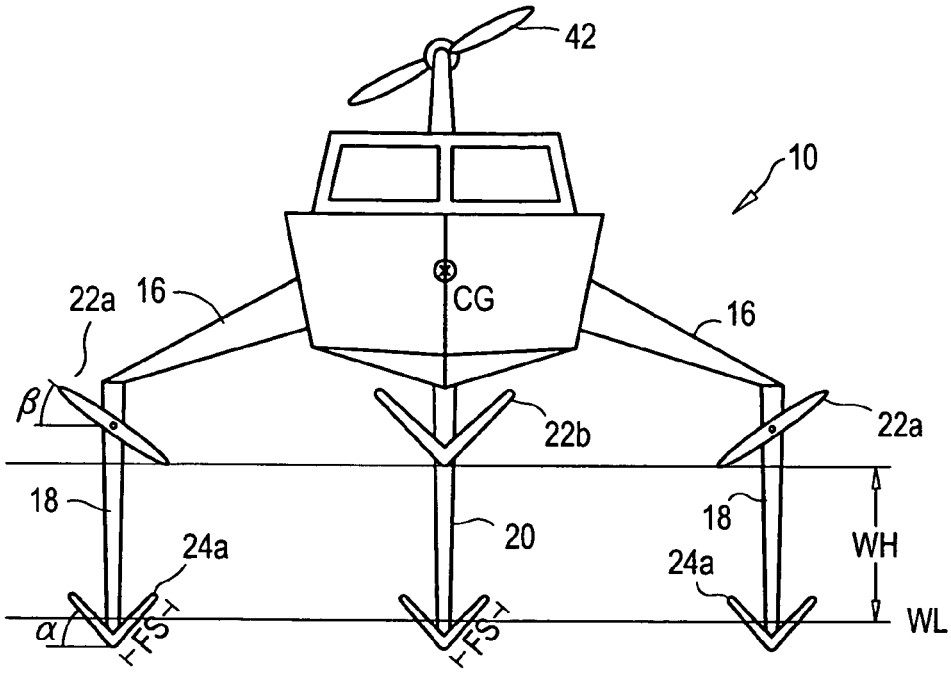
FIG. 3 is a front view of the hydrofoil marine craft of the present invention.

In an exemplary embodiment, as shown in FIGS. 2 and 3, the hydrofoil marine craft 10 includes a conventional hydrofoil arrangement, having a pair of lifting bodies positioned fore of the craft's center of gravity "CG", symmetrical about the craft's longitudinal centerline, and lifting bodies positioned aft of the craft's center of gravity along the craft's longitudinal centerline. Each of the fore lifting bodies is attached to the craft's hull 14 with a support structure, which includes a strut 16 and a pylon 18. The struts 16 are affixed to the craft's hull 14 and extend laterally outward from the craft 10. The pylons 18 are affixed to the ends of the struts 16, opposite the craft 10, and extend substantially, vertically downward, where the lifting bodies are operably connected to the pylons 18. The strut 16 can be used to provide increased roll stability to the craft 10, where the lateral distance that the strut 16 extends is a function of the craft's 10 specific configuration, depending on the craft's 10 operational parameters. Alternatively, the pylons 18 can be affixed directly to the hull 14. The aft lifting bodies are attached to the craft's hull 14 with a center pylon 20, where the center pylon 20 is affixed to the hull 14 along the craft's centerline and the lifting bodies are operably connected to the center pylon 20.

In an exemplary embodiment, as shown in FIG. 3, the upper lifting bodies are takeoff foils 22*a* and 22*b* and lower lifting bodies are main foils 24*a* and 24*b*. The takeoff foils 22*a* and 22*b* are positioned on the pylons 18 and 20 above the main foils 24*a* and 24*b* and are used to provide lift at lower speeds, initially raising the craft 10 above the waterline "WL". As the speed of the craft 10 increases to the cruising speed, the main foils 24*a* and 24*b* produce sufficient lift to support the weight of the craft 10, further raising the craft 10 and takeoff foils 22*a* and 22*b* above the waterline "WL" to the targeted cruising height. The distance between the main foils' 24*a* and 24*b* mid span and the takeoff foils 22*a* and 22*b* is such that at the target cruising height, a distance "WH" is maintained between the lowest sections of the lifting surfaces of the takeoff foils 22*a* and 22*b* and the waterline "WL". The distance "WH" is an operational parameter, dependent on the selected maximum operational wave height. For example, the distance "WH" is substantially equal to one-half the wave height.

The fore main foils 24*a* are surface piercing foils, where at the target cruise height a portion of the fore main foil 24*a* extends through and above the waterline "WL." The fore main foils 24*a* each include a pair of dihedral foil sections symmetrically attached to the pylon 18 at an angle $\alpha$ from the horizontal axis, where the angle $\alpha$ can be between about 15 degrees and 50 degrees. At the target cruise height, the submerged portion of the fore main foils 24*a* can be from 33% to 80% of the foil's span length "FS", and in an embodiment can be about 50% of the main foil's span length "FS".

The fore takeoff foils 22*a* are dihedral foil sections asymmetrically attached to the pylons 18 at an angle $\beta$ from the horizontal axis, where the fore takeoff foils 22*a* are directed inward and downward, towards the craft's 10 center line. The dihedral angle $\beta$ can be between about 10 degrees and 45 degrees. The distance "WH" is measured from the lower tip of the takeoff foils 22*a* to the water line "WL."

The aft main foils 24*b* are surface piercing foils, where at the target cruise height a portion of the aft main foil 24*b* extends through and above the waterline "WL." The aft main foils 24*b* include a pair of dihedral foil sections symmetrically attached to the center pylon 20. The dihedral angle of the aft main foil 24*b* is configured such that the upper most elevation of the aft main foil 24*b* tips matches the upper most elevation of the fore main foil 24*a* tips, and the lowest elevation of the aft main foil 24*b* matches the lowest most elevation of the fore main foil 24*a*. At the targeted cruise height, the submerged portion of the aft main foil 2*a* can be from 33% to 80% of the foil's span length "FS", and in an embodiment can be about 50% of the main foil's span length "FS".

The aft takeoff foil 22*b* includes a pair of dihedral foil sections symmetrically attached to the center pylon 20. The dihedral angle of the aft takeoff foil 22*b* is configured such that the upper most elevation of the aft takeoff foil 22*b* tips matches the upper most elevation of the fore takeoff foil 22*a* tips, and the lowest elevation of the aft takeoff foil 22*b* matches the lowest most elevation of the fore takeoff foils 22*a*. The distance "WH" is measured from the lower portion of the interface between the aft takeoff foil 22*b* and the center pylon 20 to the water line "WL."

The shock mitigation system of the present invention maintains the lift equilibrium between the fore and aft main foils 24*a* and 24*b* during wave impact. As shown in FIG. 3, at a selected cruise height the waterline "WL" is positioned at about one-half the span of the fore and aft main foils 24*a* and 24*b*, where the end tips of the fore and aft main foils 24*a* and 24*b* extend above the waterline "WL". As such, the lift provided by the submerged portions of the fore and aft main foils 24*a* and 24*b* is in a state of equilibrium. When a wave impacts the craft 10, additional portions of the fore and aft main foils 24*a* and 24*b* will be temporary submerged, providing an instantaneous increase in lift. To maintain the lift equilibrium between the fore and aft main foils 24*a* and 24*b*, the ratio of instantaneous lift provided by the fore and aft main foils 24*a* and 24*b* should be substantially equal to the lift ratio of the fore and aft main foils 24*a* and 24*b* in calm seas.

Shock mitigation occurs when a wave washes completely over the main foils 24*a* and 24*b*. The normal lift equals the all-up weight when the foils are 50% wetted. When totally wetted, the maximum lift is limited to twice the all-up weight—capping the lift force at+100% of the designed lift. A wave trough can uncover the foil reducing the lift to zero, capping the lift at minus 100%. This shock mitigation to plus or minus 100% is intrinsic to the present invention.

Figure 4:
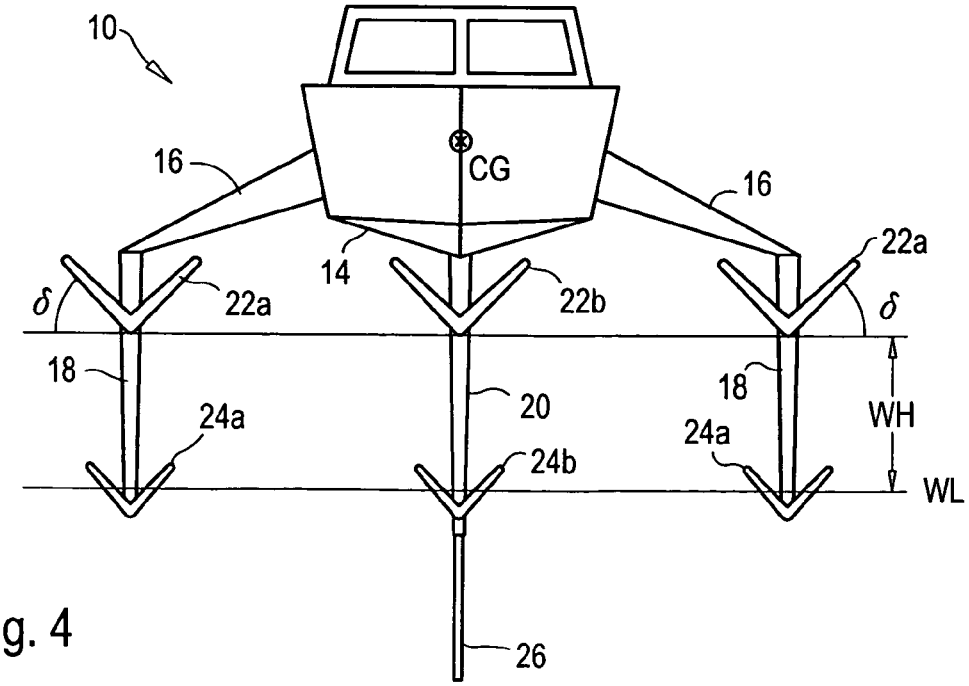
FIG. 4 is a front view of an alternative hydrofoil marine craft configuration of the present invention, including a vertical stabilizer.

Additionally, as show in FIG. 4, the fore takeoff foils 22*a* can include a pair of dihedral foil sections symmetrically attached to the pylon 18 at a dihedral angle $\delta$ from the horizontal axis, where the angle 6 can be between about 10 degrees and 45 degrees. The distance "WH" is measured from the lower portion of the interface between the fore takeoff foils 22*a* and the pylons 18 to the waterline "WL."

In a further exemplary embodiment, at least one vertical stabilizer 26 is affixed to and extends from at least one of the pylons 18 and 20. As shown in FIG. 4, a vertical stabilizer 26 is affixed to and extends from the aft center pylon 20, where the vertical stabilizer 26 provides additional stability to prevent the craft 10 from yawing. The vertical stabilizer 26 can additional dampen roll. Alternatively, the vertical stabilizer 26 is retractable, where the vertically stabilizer, for example, is drawn up into the pylons 18 and 20.

Figure 5:
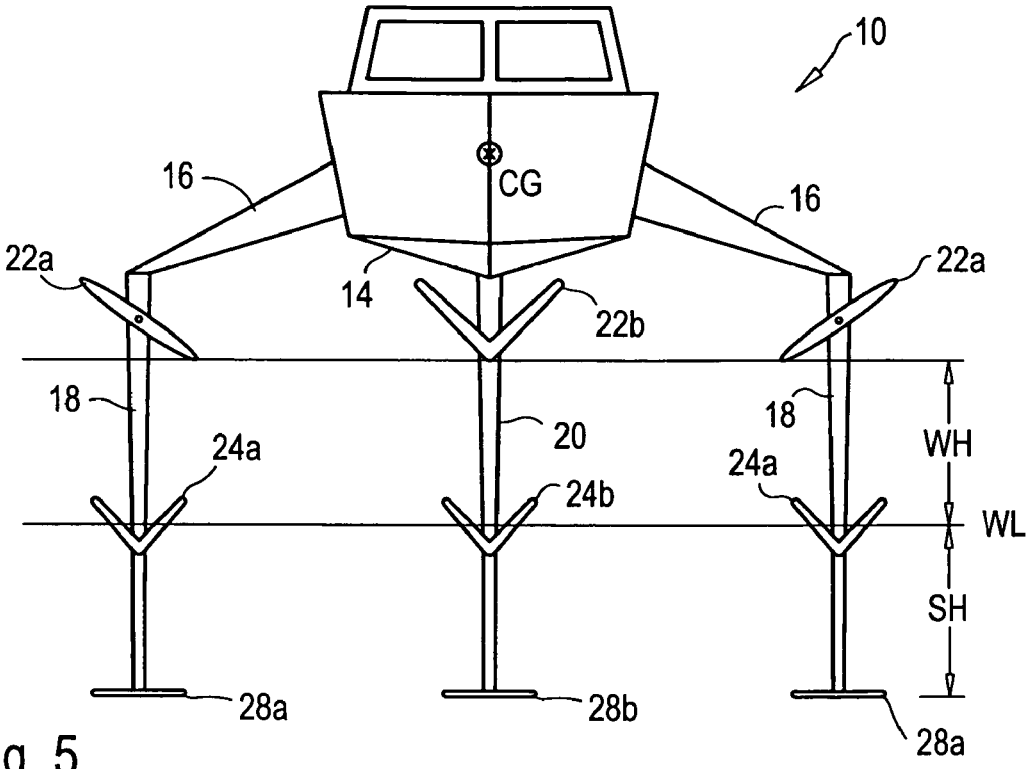
FIG. 5 is a front view of an alternative hydrofoil marine craft configuration of the present invention, including submerged hydrofoils.

As shown in FIG. 5, the hydrofoil marine craft 10 can further include a set of submerged foils 28*a* and 28*b*. The submerged foils 28*a* and 28*b* are mounted on the pylons 18 and 20 below the main foils 24*a* and 24*b*. The submerged foils 28*a* and 28*b* are configured to provide a lifting force such that the submerged foils 28*a* and 28*b* operating cooperatively with the main foils 24*a* and 24*b* to provide the all-up lift at the cruising speed. The submerged foils 28*a* and 28*b* partially uncouple the craft 10 from the effects of the waves, while maintaining the intrinsic stability provided by the surface piercing main foils 24*a* and 24*b*.

The submerged foils 28*a* and 28*b* are positioned a distance "SH" below the main foils 24*a* and 24*b*, where the distance "SH" is at least equal to or greater than "WH." In an exemplary embodiment, "SH" is substantially equal to "WH" plus four times the chord length of the submerged foils 28*a* and 28*b*.

Figure 6:
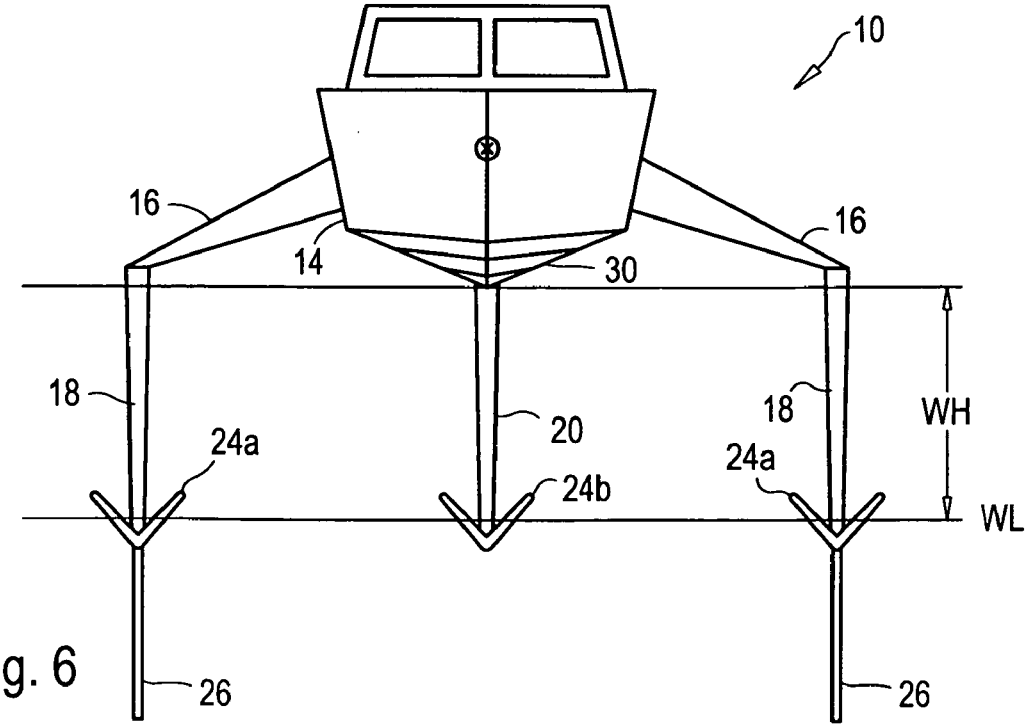
FIG. 6 is a front view of an exemplary hydrofoil marine craft including a planing hull configuration of the present invention.

In an alternative exemplary embodiment, as shown in FIG. 6, the hydrofoil marine craft 10 is a planing craft, where the craft's hull 14 is a planing hull capable of providing lift at lower speed, acting as an upper lift body 30. As the craft's speed is increased, the craft 10 rises to plane, raising a substantial portion of the craft's hull 14 above the waterline. As the speed is further increased, the lower lifting bodies, main foils 24*a* and 24*b*, produce sufficient lift to raise the craft 10 to the target cruise height. The distance "WH" is measured from the lowest point on the hull 14 to the waterline "WL" and is maintained at cruising speed.

The hydrofoil marine craft 10 can optionally include a tandem foil arrangement, including pairs of struts and hydrofoils positioned fore and aft of the craft's center of gravity and symmetrically about the craft's longitudinal centerline.

Alternatively, the hydrofoil marine craft 10 can optionally include a canard hydrofoil arrangement, having lifting bodies positioned fore of the crafts center of gravity along the craft's longitudinal centerline, and a pair lifting bodies positioned aft of the craft's center of gravity "CG", symmetrical about the craft's longitudinal centerline.

The hydrofoil marine craft 10 of the present invention is configured to optimally operate at a cruising height, where a height "WH" is maintained between the waterline "WL" and the upper lifting surfaces. As shown in FIG. 2, a propulsion system is provided to power the craft 10, where the propulsion system includes an engine 32 for providing thrust. As the main foils' 24*a* and 24*b* lift decreases, the height of the craft 10 will decrease, requiring an increase in thrust. As the main foils' 24*a* and 24*b* lift increases, the height of the craft 10 will increase, requiring a decrease in thrust.

A height measurement device 36 is included to indicate the craft's 10 height "CH" above the waterline "WL." The height measurement device 36 can be a height sensor configured for transmitting and receiving ultra sound waves, radio waves, or laser energy. The height can also be measured by an electromechanical device, electro-optical device, pneumatic-mechanical device, or other height measurement device known in the art. Alternatively, the height can be measured by a device mounted on a main foil 24*a* to detect the waterline "WL" position in relation to the mid span position of the foil 24*a*. The height measurement device 36 displays the craft's 10 height, enabling the operator to increase or decrease the thrust as needed.

Figure 7:
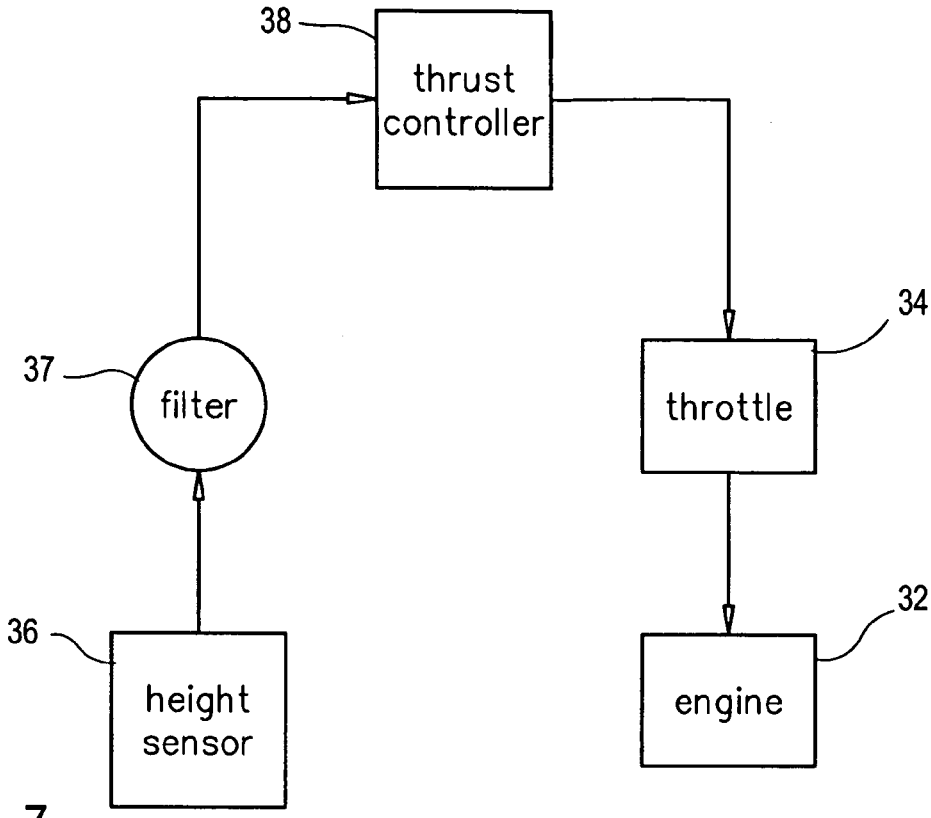
FIG. 7 is a flow chart for a variable thrust control system of the present invention.

The hydrofoil marine craft 10 can include a thrust controller 38. As shown in FIG. 7, a flow chart for the thrust controller 38, the thrust controller 38 is operably connected to the height measurement device 36, the engine 32, and the throttle 34. A filter 37 is interposed between the height measurement device and the thrust controller 38, where the filter 37 removes noise that can be caused by choppy or rough seas. The thrust controller 38 automatically adjusts the throttle 34, adjusting the engine's 32 output, in response to the craft's 10 height. As the height of the craft 10 decreases, the thrust controller 36 will increase in thrust, raising the craft 10. Similarly, as the height of the craft 10 increases, the thrust controller 38 decreases the thrust, lowering the craft. The thrust controller 38 optimally maintains the average height of the craft 10, such that the distance "WH" is maintained between the upper lifting surface and the water line "WL."

The height of the craft 10 can be adjusted by changing the lifting forces acting on the main foils 24*a* and 24*b*, thereby modifying the coefficient of lift of the hydrofoils. For example, the lifting forces acting on the main foils 24*a* and 24*b* can be adjusted by changing the angle of attack ω. Increasing the angle of attack ω will increase the lifting forces acting on the main foils 24*a* and 24*b*, resulting in a higher coefficient of lift. Decreasing the angle of attack ω will decrease the lifting forces acting on the main foils 24*a* and 24*b*, causing a reduction in the coefficient of lift.

Figure 8:
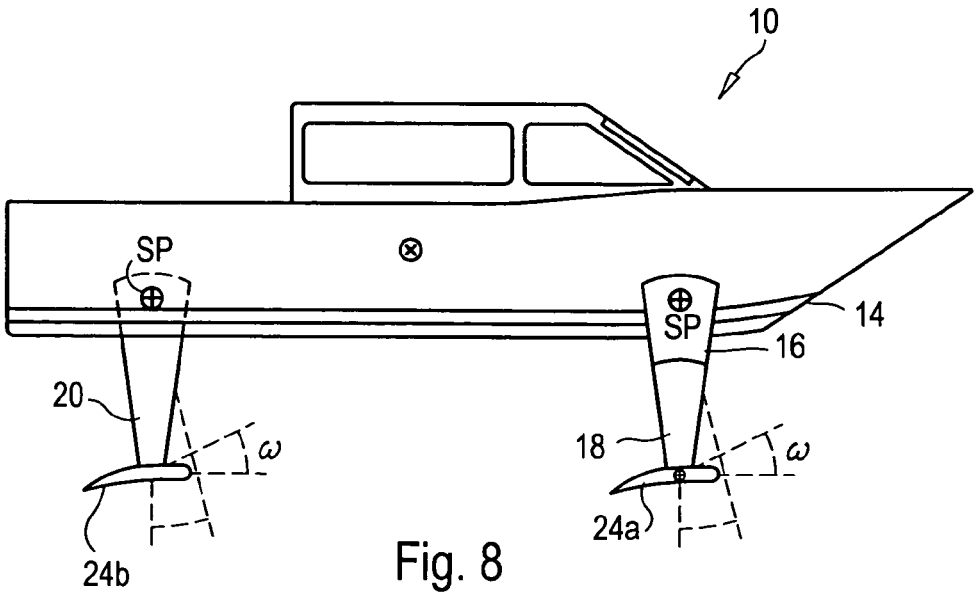
FIG. 8 is a side view of a hydrofoil marine craft including lower hydrofoil with an adjustable angle of attack configuration of the present invention.

As showing in FIG. 8, the main foils 24*a* and 24*b* are pivotally connected to the pylons 18 and 20, and are rotatable about pivot axis "FP". The angle of attack ω of the main foils 24*a* and 24*b* is adjusted by rotating the main foils 24*a* and 24*b* about the pivot axis "FP" to the desired angle of attack ω.

Alternatively, the pylons 18 and 20 are pivotally connected to the struts 16, or optionally to craft's hull 14, and rotatable about pivot axis "SP". The angle of attack ω of the main foils 24*a* and 24*b* is adjusted by rotating the pylons 18 and 20 about the pivot axis "SP", thereby increasing or decreasing the foils'angle of attack ω. Additionally, as the pylons 18 and 20 rotate about the pivot axis "SP", the angle of attack of the takeoff foils 22*a* and 22*b* will be simultaneously changed with the main foils' 24*a* and 24*b* angle of attack.

The main foils 24*a* and 24*b* can also be used to maintain pitch stability of the craft. The angle of attack of the fore main foil 24*a* or aft main foils 24*b* can be individual adjusted to maintain the craft at the appropriate pitch angle.

Figure 9:
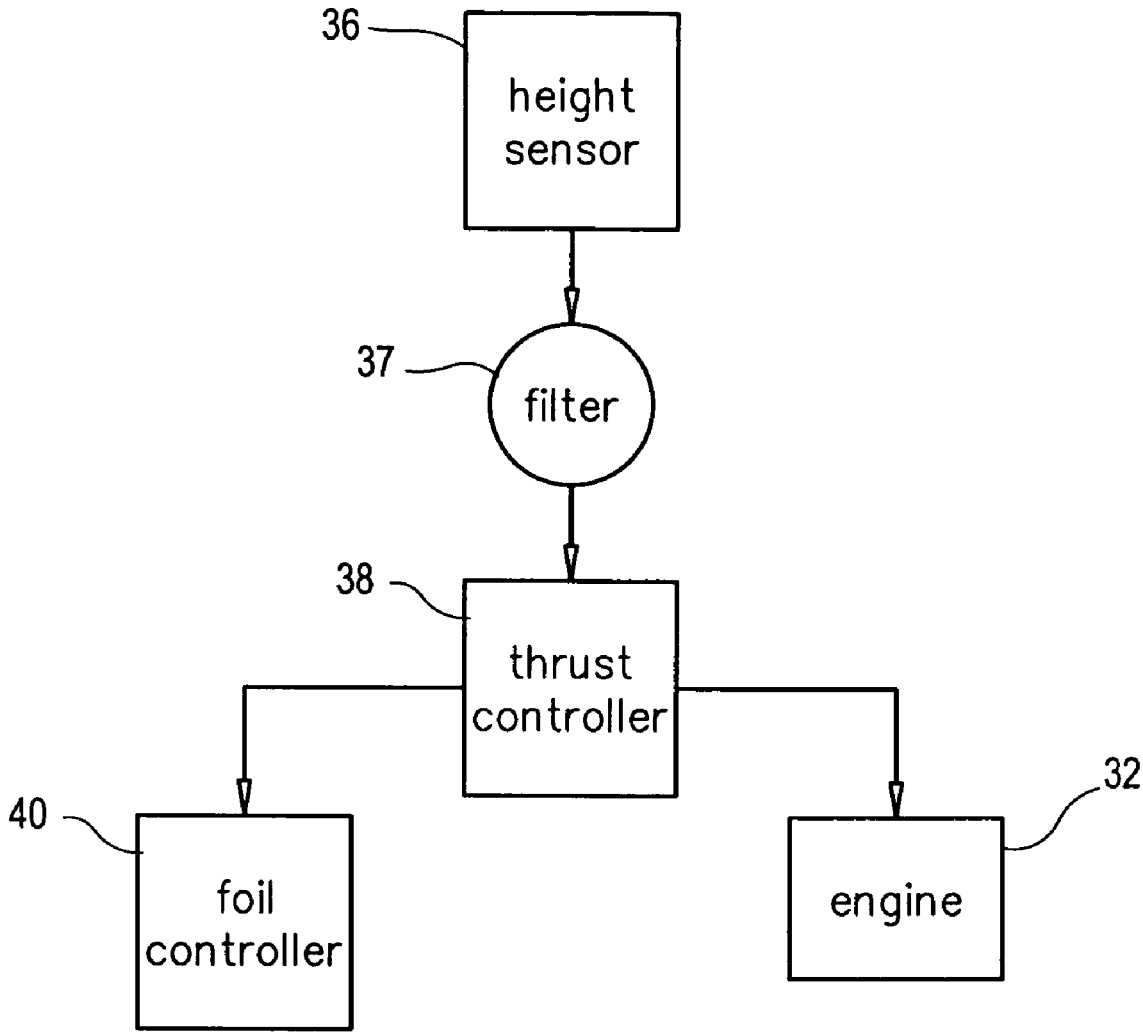
FIG. 9 is a flow chart for a cruise height control system of the present invention.

The height of the craft 10 can also be adjusted by simultaneously adjusting the thrust and the foils' angle of attack ω. As shown in FIG. 9, a flow chart for the thrust controller 38, the thrust controller is operably connected to the height indicator 36, the engine 32, and system for adjusting the foils' angle of attack 40. The thrust controller 38 automatically adjusts the engine's 32 output and foils' angle of attack ω in response to the craft's 10 height. As the height of the craft 10 decreases, the thrust controller 38 will increase the thrust and/or modifies the foils' angle of attack ω to increase lift, thereby raising the craft 10. Similarly, as the height of the craft 10 increases, the thrust controller 38 decreases the thrust and/or modifies the foils' angle of attack ω to decrease lift, thereby lowering the craft 10. The thrust controller 32 optimally maintains the height of the craft 10, such that the distance "WH" is maintained between the lower lifting surfaces and the water line "WL."

In an alternative embodiment, the height measurement device 36 can be used to measure a hydrofoil wetted portion. For example, as the distance between the measurement device 36 and a main foil 24*a* is known, by determining the distance between the waterline and the height measurement device, the portion of the main foil 24*a* that is wetted, i.e., submerged below the waterline, can be determined. Of course, a sensor or other device may be mounted directly on a foil in order to determine the hydrofoil wetted portion.

Similarly to maintaining a cruise height above the waterline as described above, propulsion and other operating characteristics of the hydrofoil marine craft 10 can be modified in order to maintain the hydrofoil marine craft 10 at a selected hydrofoil wetted portion when in operation. The thrust controller 38 can be operably connected to the height measurement device 36, the engine 32, and the throttle 34, such that the thrust controller 38 automatically adjusts the throttle 34 in response to the measured hydrofoil wetted portion. If the measured hydrofoil wetted portion is greater than the selected hydrofoil wetted position, i.e., the hydrofoil is submerged beyond the selected position, the thrust controller 38 will increase in thrust, thereby raising the hydrofoil craft 10 and reducing the amount of the foil that is wetted. Similarly, if the hydrofoil wetted portion is less than the selected wetted position, the thrust controller 38 decreases the thrust, thereby lowering the craft 10 and increasing the portion of the hydrofoil that is submerged.

In addition, the height of the craft and thus the hydrofoil wetted position can be adjusted by changing the lifting forces acting on the main foils 24*a* and 24*b*, thereby modifying the coefficient of lift of the hydrofoils. For example, increasing the angle of attack ω of the main foils 24*a* and 24*b* will increase the lifting forces, and thereby increase the coefficient of lift of the hydrofoils. Subsequently, the angle of attack ω can be decreased for the main foils 24*a* and 24*b*, resulting in a reduction in lifting forces and a reduction of the coefficient of lift for the hydrofoils. Accordingly, the height of the craft 10 and thus the hydrofoil wetted portion can be adjusted by either modifying the thrust of the craft or the coefficient of lift of the main foils, or by simultaneously adjusting both the thrust and the coefficient of lift.

Figure 10:
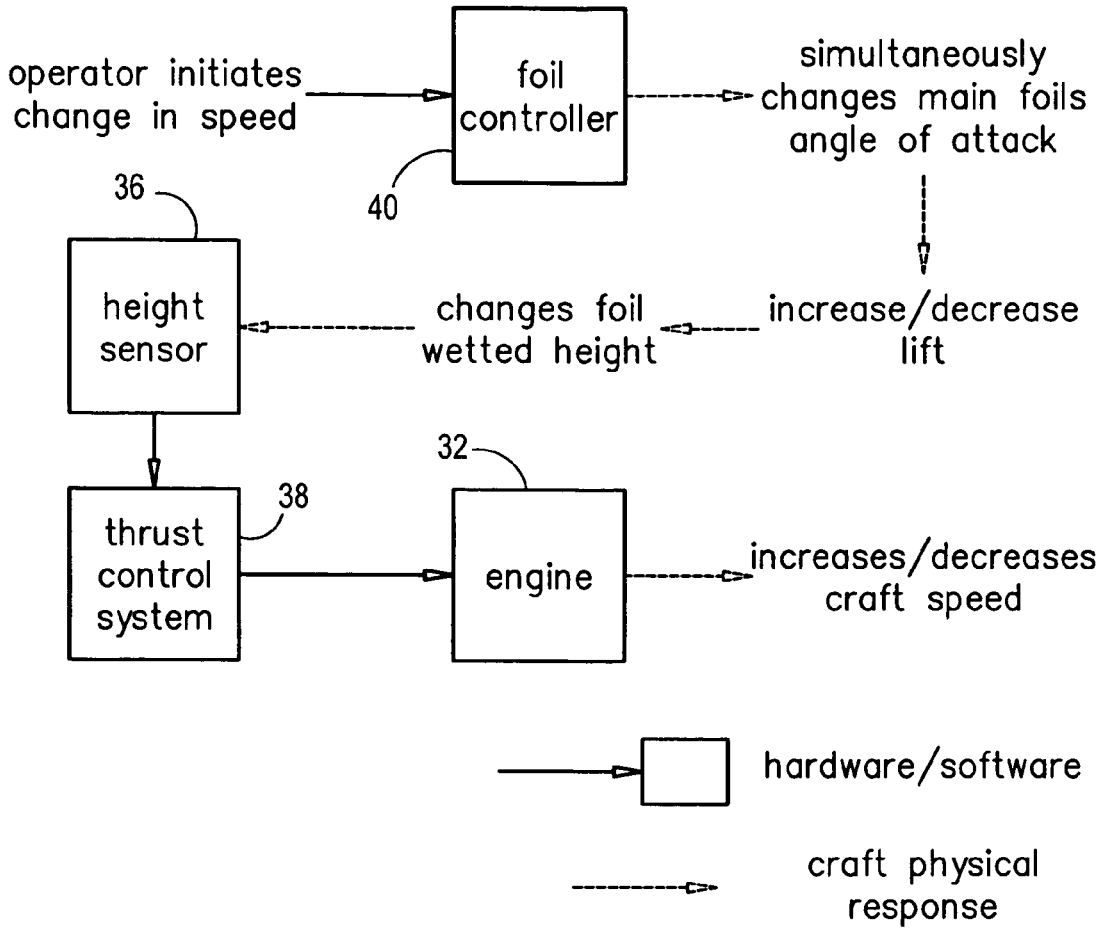
FIG. 10 is a flow chart for a cruise speed control system of the present invention.

Advantageously, the variable thrust/height control system can also be used to increase or decrease the cruising speed. As shown in FIG. 10, the operator can initiate a speed change by changing the angle of attack. The foil control 40 changes the angle attack of all main foils simultaneously. The change in the angle of attack results in an increase or decrease in the lifting force provided by the main foils, causing the waterline "WL" position to change on the main foils. The change in the height of the craft is detected by the height measurement device 36 and is transmitted to the thrust controller 38. In response, the thrust controller 38 adjusts the engine's 32 thrust achieving an increase or decrease in the cruising speed, while maintaining the craft at the target cruise height.

As described, various operational characteristics of the hydrofoil marine craft 10, including coefficient of lift and angle of attack of lifting surfaces, as well as thrust provided by a propulsion system, can be modified either individually or jointly in order to maintain or change a cruise height, cruise speed, or wetted portion of a hydrofoil. Such changes to the operational characteristics can be made automatically in response to changes in the surrounding environment, i.e., due to increased wave height or the like, or can be made manually by an operator.

As shown in FIGS. 2 and 3, the propulsion system can include at least one air propeller 42 mounted to the deck 44 of the craft 10, were the air propeller 42 is operably connected to the engine 32. Alternatively, the propulsion system can include a water propeller, where a drive shaft is mounted through at least one of the pylons, operatively connecting the water propeller to the engine. Additionally, the propulsion system can be a water jet or a pump jet, and can include more than one air or water propellers.

The hydrofoil marine craft 10 further includes a direction control system for turning the hydrofoil marine craft 10. The direction of the hydrofoil marine craft 10 can be adjusted by selectively changing the lifting forces acting on the hydrofoils causing the hydrofoil marine craft 10 to roll onto a banked turn, such as by creating a lifting force differential between the starboard and port foils. For example, to make a starboard turn, a lifting force differential is created between the starboard foil and port foil, where the port foil has a greater lifting force than the starboard foil. As noted above, the lifting forces acting on the foils can be adjusted by differentially changing the angle of attack of the outboard foils. At a given speed, increasing the foil's angle of attack will increase the lifting forces action on the foils. Decreasing the angle of attack will decrease the lifting forces acting on the foils.

As showing in FIG. 8, the main foils 24*a* and 24*b* are pivotally connected to the pylons 18 and 20, and are rotatable about pivot axis "FP". The angle of attack 0) of the main foils 24*a* and 24*b* are adjusted by rotating the main foils 24*a* and 24*b* about the pivot axis "FP" to the desired angle of attack ω.

Alternatively, as shown in FIG. 8, the pylons 18 and 20 are pivotally connected to the struts 16, or optionally to craft's hull 14, and rotatable about pivot axis "SP". The angle of attack ω of the main foils 24*a* and 24*b* is adjusted by rotating the pylons 18 and 20 about the pivot axis "SP", thereby increasing or decreasing the angle of attack ω.

Additionally, the small changes in the differential forces required to achieve a banked turn can by accomplished by adjusting control surfaces on the fore main foils 24*a* as is know in the art. For example, the fore main foils 24*a* can include a set of trim tabs, which when actuated change the fore main foil's 24*a* lift profile, differentially increasing or decreasing the lifting forces action on the main foils 24*a*.

Additionally, the vertical stabilizer 26 can be used as a rudder, providing directional control for the hydrofoil marine craft 10. In an exemplary embodiment, as shown in FIG. 6, a pair of vertical stabilizers 26 extends from the fore pylons 18, and are pivotal about a vertical axis "V." As the vertical stabilizers 26 are rotated about the vertical axis "V," the water flow over the vertical stabilizers 26 will cause the hydrofoil marine craft 10 to change directions. As shown in FIG. 4, a vertical stabilizer 36 can also pivotally extend from the aft pylon 20, functioning as a stand-alone rudder or in combination with the fore pylons 18.

In a still further embodiment, the craft's direction is controllable by directing the thrust. For example, the propulsion system can include a thrust directional controller.

The shock mitigation system for hydrofoil marine craft of the present invention has been exemplary described using a mono-hull craft. However, the shock mitigation system can also be applied to multi-hull craft, including catamarans and trimarans.

Having explained features and functions of a shock mitigation system and its exemplary components, additional discussion is now provided with respect to alternative foil embodiments set forth in FIGS. 11–16. Specifically, although cambered foils can function effectively to act as lifting bodies, other foil configurations are also desirable. For example, a foil can be configured to provide lift for the craft by shaping the foil and/or angling the foil (or a portion thereof) with respect to a reference, such as a motion path, so that it impacts or travels through water at a defined angle or presents a foil face that deflects or pushes the craft upward as it moves forward. This type of foil can be particularly advantageous at speeds ranging from about 50 to 75 knots.

Figure 11:
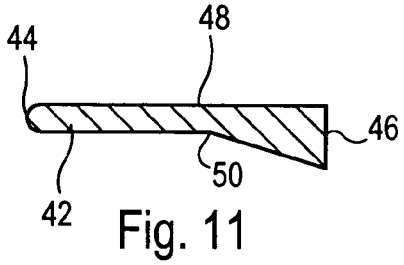
FIG. 11 is a sectional view of a foil in accordance with the invention.
Figure 13:
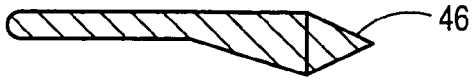
FIG. 13 is a sectional view of yet another foil in accordance with the invention.

An example of such a foil is shown in FIG. 11, wherein a foil 42 having a leading edge 44 and a trailing edge 46 is shown in cross-section. In this view it is apparent that the foil is not cambered and that the upper surface 48 is substantially flat. The opposing lower surface 50 diverges from the upper surface 48 increasingly from the leading edge 44 to the trailing edge to provide a deflection surface. The leading edge 48 is shown as being rounded or blunt; however, it can be "pointed" as well. The trailing edge 46 is shown as flat face that is substantially perpendicular to the upper surface 48; however, as shown in FIG. 13, the trailing edge can include a tapered configuration.

Thus, in use, the foil 42 is oriented so that water traveling over the upper surface is not accelerated by the shape or position of the foil to create lift. By contrast, the fluid flowing across the lower surface 50 is pressurized by the impingement of fluid against the lower surface or portion thereof that is presented to the fluid as it traverses the foil before passing behind it, thereby applying a lifting force to the craft.

Figure 12:
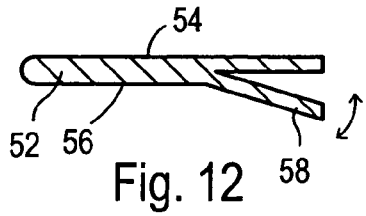
FIG. 12 is a sectional view of another foil in accordance with the invention.

Referring now to FIG. 12, a foil 52 is provided having a substantially flat upper surface 54, a substantially flat lower surface 56 and a positionable element 58 that can be moved as shown by the bidirectional arrow to create an angular difference between the flat lower surface 56 and a selected reference, thereby creating a deflection surface against which a flow a water impinges to create a lifting force for the craft. By modifying the angle of the positionable element 58 to increase or decrease lift, the flat upper surface 54 remains substantially level, thereby reducing the potential for cavitations likely to occur across the upper surface 54 if the angle of attack of the entire foil 52 was adjusted.

Figure 14:
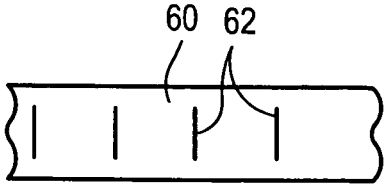
FIG. 14 illustrates the top surface of a foil showing fences disposed along the span of the foil.
Figure 15:
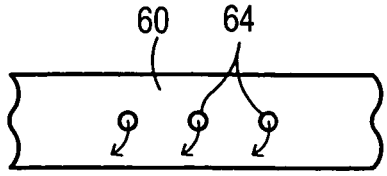
FIG. 15 illustrates the top surface of a foil showing an alternate structure for upper surface boundary layer control.

Yet another feature of the invention is shown in FIGS. 14 and 15 where the upper surface 60 of a foil section is shown provided with boundary layer control devices to improve laminar flow and to hinder span-wise flow of fluid traversing the upper surface of any foil described hereinabove, but especially cambered foils. For example, FIG. 14 depicts fences 62 disposed span-wise across the foil; and FIG. 15 discloses an array of apertures through which high energy fluid can be ejected as represented by the arrows.

Figure 16:
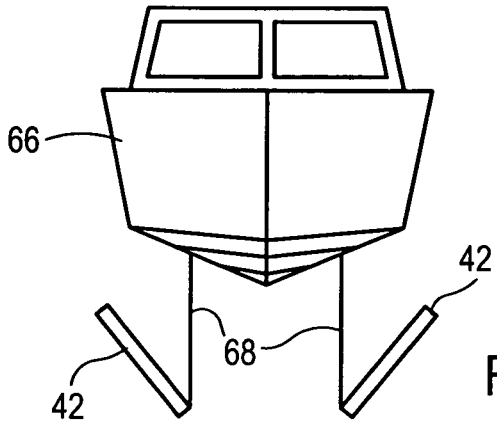
FIG. 16. is a view of from the bow of a vessel looking aft and showing foils as set forth in FIG. 11.

FIG. 16 depicts a portion of a craft 66 (looking fore to aft) provided with foils 42 as set forth in FIGS. 11. By contrast with other configurations, the configuration of FIG. 16 includes only a singe foil on each pylon 68.

As described above, the system limits vertical lift forces, as well as lateral forces on a craft by separation of the traditional lift generating function of a hull, by using pylon mounted foils, from the cabin, deck, and payload carrying features of the hull. The resultant vertical separation is equal to or greater than the expected operational wave height. Thus, the lift at operational sped is limited to a vertical force equal to the weight of the loaded hull plus a safety factor that might range from 20 to 100 percent of the loaded weight. Lateral forces applied to the craft are limited by the relatively small surface area of the pylons as compared to the freeboard of a conventional monohull.

Figure 17:
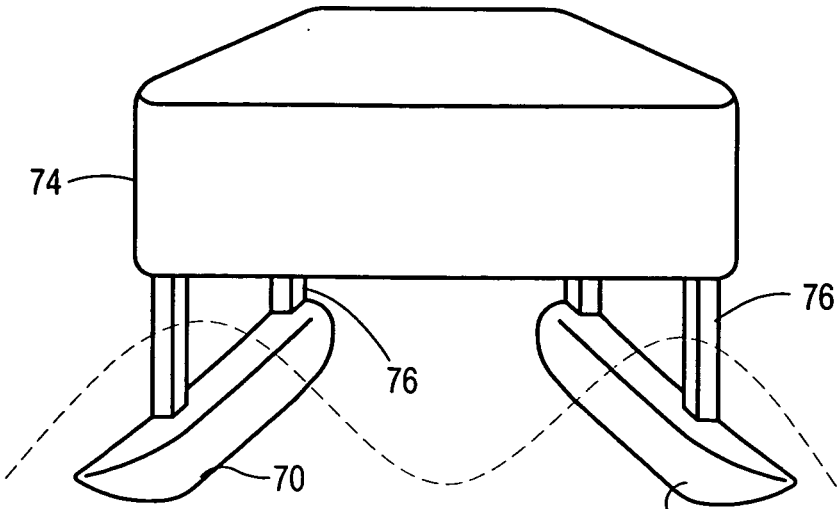
FIG. 17 illustrates another embodiment of a shock mitigation system.

Turning now to FIG. 17, yet another configuration is illustrated that mitigates shock by limited vertical and lateral forces. As shown, a catamaran configuration is provided having a first hull 70, a second hull 72, and a cargo hull 74 that is positioned above and between the first hull and second hull by struts 76 rather than a substantially hull-length longitudinal support.

Unlike the relative proximity of a traditional catamaran deck to the water surface, the cargo hull 74 in the present invention is at a height matched to the operational wave specification. Whereas a traditional catamaran is not severely affected by cargo hull impact with the water or by later forces due to relatively low speeds, speeds above 25 knots can be both punishing and destructive. By contrast, substantially total isolation of the cargo hull 74 from the water surface (and waves) in the present invention, in combination with relatively small freeboards, allows the present craft to travel smoothly at speeds above 50 knots. Should a wave wash over the first and second hulls 70 and 72, the vertical lift is limited to +1"G" plus the safety factor.

Although the first and second hulls 70 and 72 can have a traditional elongate "V" hull shape and a buoyancy or displacement so that the cargo hull 74 is above water level when the craft is at rest, the first and second hull can also be configured to that the cargo hull is at or near water level at rest with the first and second hulls submerged, wherein the first and second hull are provided with lift or planning surfaces that cause the hulls to rise to the surface or above as the speed of the craft increases.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A method of maintaining a hydrofoil marine craft at a selected cruise height above a waterline, the marine craft having a propulsion system and at least one lower lifting surface having an angle of attack and operably connected to the hydrofoil marine craft, the method comprising:

measuring a height of the hydrofoil marine craft above the waterline;

comparing the selected cruise height to the measured height;

adjusting the propulsion system, wherein a thrust provided by the propulsion system is increased when the measured height is less than the selected cruise height and the thrust is decreased when the measured height is greater than the selected cruise height.

2. A method of maintaining a hydrofoil marine craft at a selected cruise height above a waterline at a selected cruise speed, the marine craft having a propulsion system and at least one lower lifting surface having an angle of attack and operably connected to the hydrofoil marine craft, the method comprising:

operating the hydrofoil marine craft at a selected cruise speed;

modifying the selected cruise speed;

adjusting the angle of attack of the at least one lower lifting surface of the marine craft in response to the modified selected cruise speed;

measuring the height of the hydrofoil marine craft above the waterline; and adjusting the propulsion system of the marine craft to achieve a measured height substantially equal to the selected cruise height.

3. The method according to claim 2, wherein a thrust provided by the propulsion system is increased when the measured height is less than the cruise height and the thrust is decreased when the measured height is greater than the cruise height.

4. A method of maintaining a hydrofoil marine craft at a selected hydrofoil wetted portion, the marine craft having a propulsion system and at least one lower lifting surface having a coefficient of lift and operably connected to the hydrofoil marine craft, the method comprising:

measuring an average wetted hydrofoil portion;

comparing the selected hydrofoil wetted portion to the measured average wetted hydrofoil portion; and adjusting the propulsion system of the marine craft to achieve a measured average wetted hydrofoil portion substantially equal to the selected hydrofoil wetted portion.

5. The method according to claim 4, wherein a thrust provided by the propulsion system is increased when the measured average wetted hydrofoil portion is greater than the selected hydrofoil wetted portion and the thrust is decreased when the measured average wetted hydrofoil portion is less than the selected hydrofoil wetted portion.

* * * * *